US006790134B2

(12) United States Patent
Swaddle et al.

(10) Patent No.: US 6,790,134 B2
(45) Date of Patent: Sep. 14, 2004

(54) POWER TOOL

(75) Inventors: Steven Swaddle, Durham (GB); Barrie Charles Mecrow, Tyne&Wear (GB); Alan Galloway Jack, Hexham (GB)

(73) Assignee: Black & Decker Inc., Newark, DE (US)

( * ) Notice: Subject to any disclaimer, the term of this patent is extended or adjusted under 35 U.S.C. 154(b) by 92 days.

(21) Appl. No.: 09/881,232

(22) Filed: Jun. 14, 2001

(65) Prior Publication Data

US 2002/0009962 A1 Jan. 24, 2002

(30) Foreign Application Priority Data

Jun. 19, 2000 (GB) ..... 0014806

(51) Int. Cl.[7] ..... B24B 27/08
(52) U.S. Cl. ..... 451/355; 451/490; 451/548
(58) Field of Search ..... 451/355–359, 451/490, 513, 548, 504

(56) References Cited

U.S. PATENT DOCUMENTS

| | | | | | |
|---|---|---|---|---|---|
| 3,506,044 | A | | 4/1970 | Evans | |
| 3,902,284 | A | * | 9/1975 | Hestily | 451/355 |
| 4,115,957 | A | * | 9/1978 | Porth et al. | 451/355 |
| 4,274,304 | A | | 6/1981 | Curtiss | |
| 4,566,511 | A | | 1/1986 | Robinson | |
| 4,574,531 | A | * | 3/1986 | McCurry | 451/355 |
| 4,597,181 | A | | 7/1986 | Bergler | |
| 4,675,975 | A | | 6/1987 | Kucharczyk et al. | |
| 4,694,616 | A | * | 9/1987 | Lindberg | 451/357 |
| 5,269,733 | A | | 12/1993 | Anthony, III | |
| 5,649,879 | A | | 7/1997 | Kusumoto et al. | |
| 5,692,575 | A | | 12/1997 | Hellström | |
| 6,159,085 | A | * | 12/2000 | Hara | 451/451 |

FOREIGN PATENT DOCUMENTS

| | | |
|---|---|---|
| DE | 3117785 | 11/1982 |
| WO | 9825723 | 6/1998 |

* cited by examiner

*Primary Examiner*—Lee D. Wilson
(74) *Attorney, Agent, or Firm*—Harness, Dickey & Pierce, P.L.C.

(57) ABSTRACT

A power tool comprising a body (20), a motor and a roller (38), characterized in that the motor acts as the roller (38).

16 Claims, 7 Drawing Sheets

POWER TOOL

The present invention relates to a means of driving a power tool and the position of this means within the power tool and in particular a power module and an electric motor for driving a belt sander and the position of the power module and the electric motor in relation to the sandpaper belt of the belt sander.

Sandpaper is used for the removal of surface layers like, for example, a layer of varnish on a piece of wood. A piece of sandpaper may be used manually, which involves the user repeatedly rubbing the sandpaper against the layer of varnish to be removed and the abrasive nature of the sandpaper steadily removing this surface layer. The user will cease the rubbing action once satisfied that the layer of varnish has been removed, thus exposing a clean piece of wood from underneath the varnish.

Manual usage of sandpaper allows the user access to tight corners, however it may also involve a lot of time and significant effort on the part of the user. This time and effort increases with the size of the task and many would agree that the removal of a layer of varnish from the wooden floor of a room in a typical house would be too onerous a task to be attempted by manual use of sandpaper. However, a power tool in the form of an electric sander, using electrical power to drive the rubbing motion of the sandpaper against the surface layer to be removed, would complete such a task more quickly and with significantly less physical effort on the part of the user.

An electric sander uses domestic mains electrical supply or battery electrical supply to drive an electric motor, which in turn drives a mechanism capable of converting the motor's rotational motion into sandpaper rubbing motion. Sandpaper rubbing motion typically takes one of two forms.

Substantially constant flat linear motion moving relative to the stationary surface layer to be removed, as achieved by a continuous sandpaper belt with abrasive surface on the exterior, rotating quickly in the form of a flat loop about a first driven roller and a second non-driven roller, the rollers being parallel to each other.

Vibrating movement within a flat plane thus quickly moving the abrasive side of the flat sandpaper back and forth against the surface layer to be removed.

Electric sanders may embody either of the above methods of sandpaper rubbing motion depending on the manufacturing cost of the electric sander and the scale of its intended purpose. When designing an electric sander consideration must also be paid to its shape, size and ergonomics. The shape of the electric sander's body in relation to its sanding surface will influence the electric sander's ability to reach edges and tight corners, something which is not a consideration when manually using sandpaper. An electric sander employing the rubbing motion as described in (a) above is called a belt sander.

A conventional belt sander typically comprises a main body element having a handle with an electrical switch and containing an electric motor, a driving mechanism, a driven roller, a non-driven roller, and a sandpaper belt, the sandpaper belt being located on the underside of the body element and held in a flat loop by the two rollers. The rollers are connected to the body element and the driven roller is rotatably driven by the electric motor via the driving mechanism, and both the electric motor and driving mechanism are located within or attached to the body element. Some electric motors, like for example a universal motor, may be powered by a domestic mains electrical supply or battery electrical supply. Other electric motors require a power module to convert a domestic mains electrical supply or battery electrical supply into a more suitable electrical supply. The choice of motor and hence the requirement of a power module depends on the desired performance of the belt sander. If a power module is required, it is normally located in the body element of a conventional belt sander and may be powered by domestic mains electrical supply or battery electrical supply.

Typically a conventional belt sander transfers the rotational motion of the electric motor to the driven roller via a driving mechanism comprising a toothed belt and two toothed wheels, arranged in the form of a pulley system. The first toothed wheel is attached to, and rotated by, the electric motor, thereby turning the toothed belt. The toothed belt passes by the side of the sandpaper belt and turns the second toothed wheel which is attached to and rotates the driven roller. This transfer of rotational motion from the electric motor to the driven roller urges the sandpaper belt to turn about the two rollers in the shape of a flat loop, the flat lower exterior face of the sandpaper acting as an abrasive wall against the work surface.

The operation of a belt sander to polish, clean or remove the surface of materials can be hazardous due to the abrasive nature of the sandpaper belt and the rapid speed at which it travels. The user must take care to avoid any contact with the moving sandpaper belt, but the risk of injury can be reduced by a body element which encloses all moving parts except for the sandpaper belt. The toothed belt passes by the side of the sandpaper belt and must therefore extend the overall width of a conventional belt sander. For the sake of safety the toothed belt and wheels are enclosed by part of the body element which will consequently protrude beyond the width of the sandpaper belt if it is to accommodate the toothed belt and wheels. The additional protruding width of the body element inhibits a conventional belt sander from reaching edges and tight corners on the side of the protrusion, thereby occasionally requiring the user to rotate the belt sander through 180° in order to use the side of the belt sander on which the body element is substantially in line with the edge of the sandpaper belt. Furthermore, the additional protruding width limits the choice of aesthetic and ergonomic designs that can be applied to the body element of a conventional belt sander.

One aspect of the present invention embodies a new design of belt sander which makes use of the area located within the confines of the sandpaper belt by substituting a normal driven roller for a roller comprising an electric motor. The electric motor is located inside the roller and provides the means for driving the roller. Preferably the electric motor forms the driven roller, thus obviating the need for an additional driving mechanism such as the pulley system characterised by a toothed belt and wheels. In absence of the toothed belt and wheels the width of the belt sander body element may be reduced to no more than the width of the sandpaper belt plus the necessary means for attaching the rollers and other components located within the sandpaper belt to the body element.

The construction of electric motors is a precise task that may involve many different components, some of which are complicated to make. Electric motors like, for example, an induction motor may comprise a multiple-lamination steel rotor and a stator further comprising a complicated field coil, both of which can be a time consuming and therefore costly to manufacture. With the present invention the preferred choice of electric motor is a claw pole motor comprising an internal stator and an external rotor. The stator comprises at least one claw pole stator element and the rotor comprises at least one permanent magnet acting as a magnetic pole. The preferred choice of stator comprises three claw pole stator elements but, as would be apparent to the skilled person in the art, any number of claw pole stator elements may be employed, the number depending on, amongst other things, the available space and the type of power supply. Preferably the rotor comprises a plurality of permanent magnets and the preferred type of permanent magnet is a rare earth sintered magnet. The rare earth sintered magnet gives the advantage of greater flux density per unit volume in comparison to conventional permanent magnets, however other types of permanent magnet may also be used. Assembly of the components forming the claw pole motor is not complicated although this should also be done in a precise manner so that the finished motor functions correctly. A claw pole stator element forming part of the stator of the claw pole motor is constructed from a relatively low number of individual components when compared to other electric motors like, for example, an induction motor. One claw pole stator element comprises two identical and reversed half-claw members and a field coil. The field coil is formed by a simple hoop shaped coil of insulated wire which is considerably less complicated to manufacture than, for example, a field coil directly wound around the teeth of an induction motor's stator. The half-claw members may be made of mild steel or other ferromagnetic material. Preferably the half-claw members are made of an isotropic soft iron powder composite which is formed by a bonding process to produce a finished half-claw member made to suitably high tolerances such that no further machining or profiling is required before assembly. Collectively these advantages result in a claw pole motor that is inexpensive to build due to its low number of components and simple construction as well as being well suited for this type of use in a power tool.

An alternating magnetic field within a ferromagnetic body like, for example, the solid steel structure of a rotor or stator gives rise to eddy currents and other iron losses which result in the by-product of heat. Unless this production of heat can be reduced to a point where sufficient heat dissipation naturally occurs via its external components, an electric motor will need to be ventilated in order to cool it to an acceptable operating temperature. Furthermore, many electric motors comprise a commutator and carbon brush arrangement to transmit an electrical supply to the field coil of the rotor. Over time wear between the commutator and the carbon brushes results in a carbon dust that must be expelled from inside the motor to prevent malfunctioning caused by excessive carbon deposits. However, power tools operate in a dusty environment and it is also highly desirable to shield a power tool's internal moving parts from external dust so as to reduce wear and, prolong their working life. With the present invention, the rotor of the claw pole motor produces significantly less heat than an equivalent wound field rotor due to the absence of alternating magnetic flux within its permanent magnets and the attendant electrical losses. Additionally, the isotropic nature of the soft iron composite used to construct the half-claw members means that any heat that is produced within the claw pole motor may dissipate equally and in all directions. Furthermore, permanent magnets do not need an external electrical supply and so a commutator with carbon brushes is not necessary. Absence of carbon brushes and the resulting carbon dust as well as less heat production means that the claw pole motor, as according to this invention, may be of a shielded construction because internal ventilation is not necessary.

Another aspect of the present invention embodies a new design of belt sander which makes use of the area within the confines of the sandpaper belt by relocating the power module from inside the body element to within a casing, the casing being located in the space between the driven roller and the non-driven roller. This space is within the confines of the belt and is typically reserved for the belt tension adjuster alone in a conventional belt sander. The casing may additionally provide a location for a battery should the battery be the power module's source of electrical supply. Alternatively, the casing may provide a location for a battery in substitution for the power module should the electric motor be powered directly by the battery without the need for a power module. For safety reasons a belt sander, having a power module, encloses the power module in a protective casing so as to shield the user from the electrical current supplied to its components. However, these electrical currents produce heat as they flow through the components of the power module and this heat needs to be expelled otherwise the power module will overheat. The power module of a conventional belt sander is normally located within the body element which acts as a barrier to efficient heat transfer between the power module, its casing and the surrounding atmosphere. The present invention overcomes this limitation by locating the casing in the space between the driven and the non-driven rollers, this space being exposed to the atmosphere. The heat produced by the components of the power module may be transferred to an internal heat sink, the heat sink being thermally coupled to the casing so that the surface area of the casing behaves as an extension to the heat sink, thereby adding to the cooling capacity of the heat sink. This additional cooling capacity increases the rate of heat transfer from the components of the power module to the atmosphere surrounding the casing. Therefore a power module located within an external casing, as according to the present invention, is more efficiently cooled than a power module located within the body element of a conventional belt sander.

The relocation of the electric motor and the casing for the power module from within the body element to the space enclosed by the sandpaper belt is a more economic use of this space and may result in a more compact belt sander. Consequently the body element simply provides a location for the electrical switch and forms a handle to be grasped by the user because it no longer needs to accommodate any major internal components. This allows more scope for alternative styles of belt sander which may be smaller or more aesthetically pleasing to the user or purchaser.

Accordingly the present invention provides for a power tool comprising a body, a motor and, a roller, characterised in that the motor acts as the roller.

Preferably the motor is an electric motor having a stator and rotor, wherein the rotor is located outside the stator and is capable of rotating about the stator.

Preferably the rotor is the roller.

Preferably the stator is attached to the body.

Preferably the power tool further comprises a non-driven roller.

Preferably the non-driven roller is rotatably disposed upon an axle, the axle being attached to the body.

Preferably the power tool further comprises a belt, the rotor and the non-driven roller being capable of supporting the belt.

Preferably the rotor comprises a cylindrical drum and a plurality of permanent magnets, the permanent magnets being attached to the inside of the cylindrical drum.

Preferably the permanent magnets are sintered rare earth magnets.

Preferably the motor is a brushless shielded motor.

Preferably the stator is a claw pole stator comprising at least one claw pole stator element.

Preferably a claw pole stator element comprises a field coil, a first half-claw member and a second half-claw member, the first half-claw member comprising a first central element and a plurality of claws, the claws being arranged in equi-angular intervals around the perimeter of the first half-claw member, and the second half-claw member comprising a second central element and a plurality of claws, the claws being arranged in equi-angular intervals around the perimeter of the second half-claw member, wherein the claw pole stator element is formed when the first half claw member and the second half claw member are joined at the first central element and the second central element thereby causing the claws to juxtapose about the perimeter of the first half-claw member and the second half-claw member, the claws enclosing the field coil and, the field coil surrounding the joined first central element and second central element.

Preferably the first half-claw member and the second half-claw member are formed of an isotropic ferromagnetic composite material.

Preferably the claw pole stator further comprises a shaft and a plurality of claw pole stator elements the claw pole stator elements each concentrically disposed upon the shaft.

Preferably the shaft is formed of a non-magnetic material.

Additionally or alternatively the stator comprises a laminated core having a plurality of laminated teeth, a field coil and, a shaft, the laminated core being fixedly secured upon the shaft.

The present invention will now be described, by way of example only and, with reference to the following drawings, of which:

Figure 1:
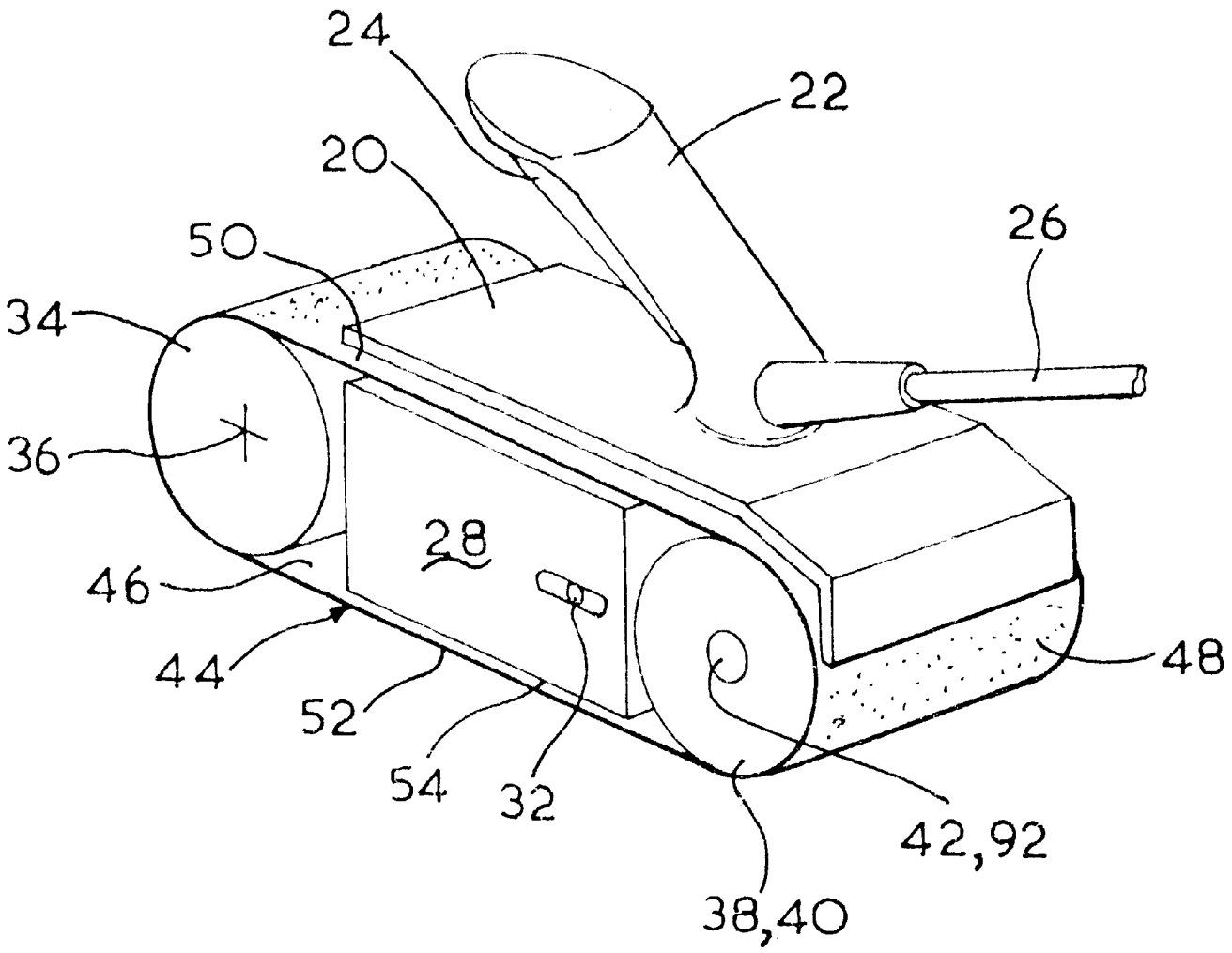
FIG. 1 shows a perspective view of an embodiment of the belt sander in accordance with the present invention.
Figure 2:
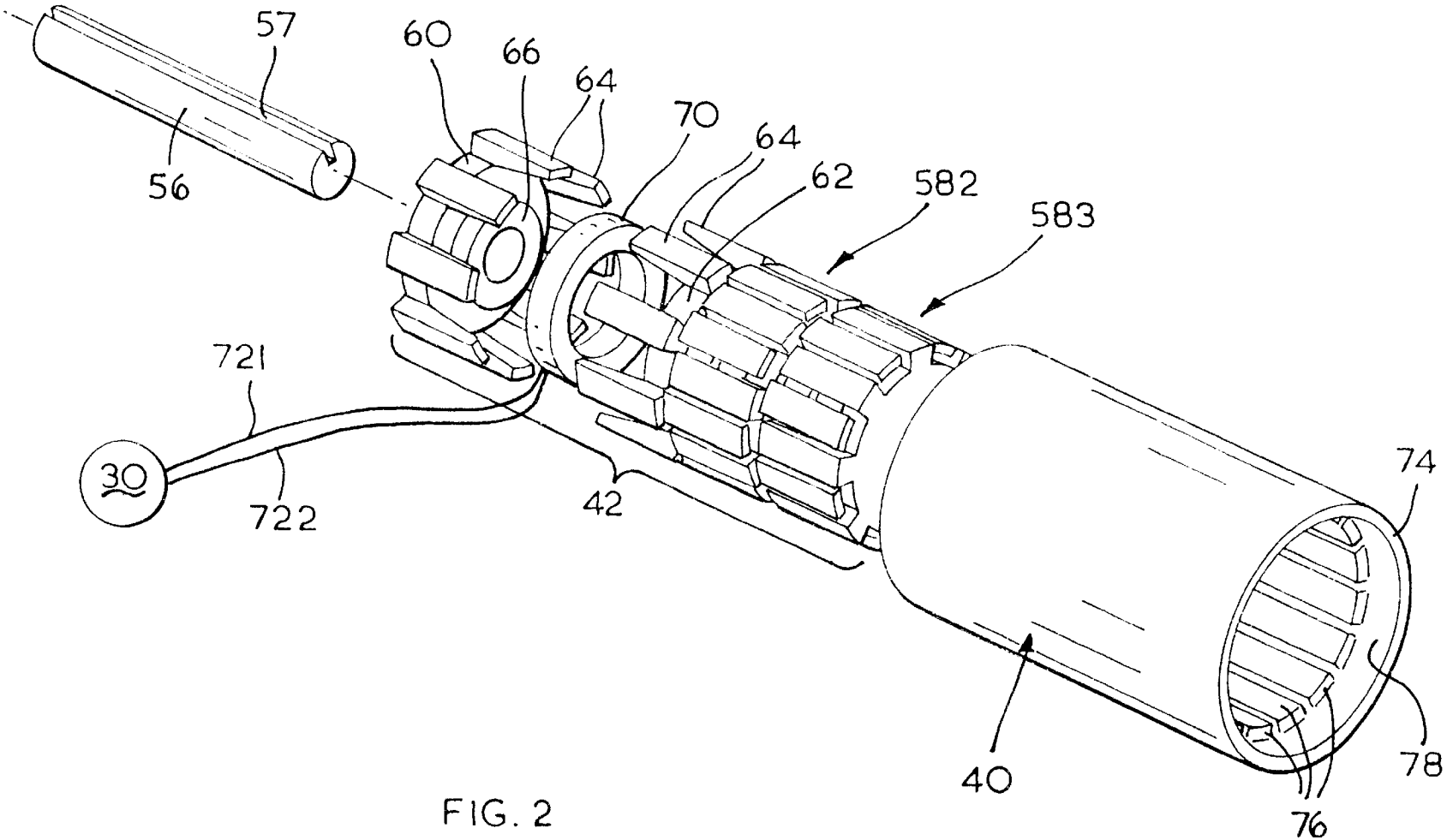
FIG. 2 shows an exploded perspective view of a claw pole motor comprising two assembled and one disassembled claw pole stator elements, a motor shaft and an external rotor drum.
Figure 3:
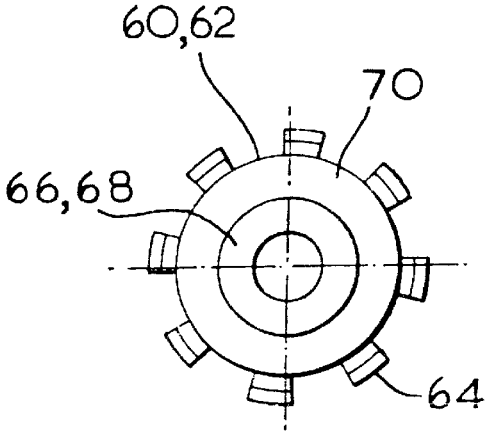
FIG. 3 shows a front elevation view of a half-claw member.
Figure 4:
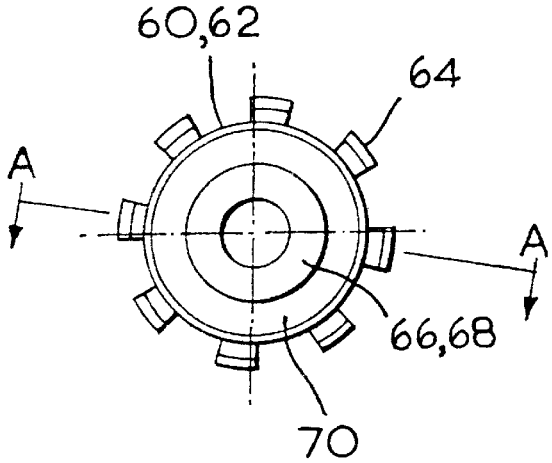
FIG. 4 shows a front elevation view of a half-claw member and field coil.
Figure 5:
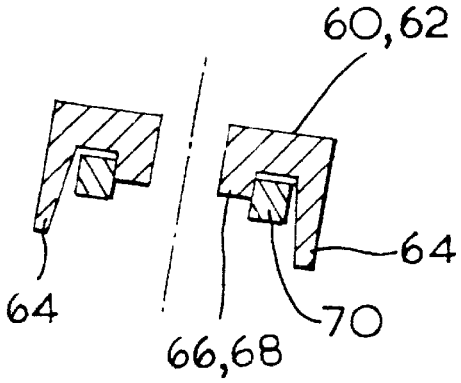
FIG. 5 shows a cross-sectional view A—A of the half-claw member and field coil shown in FIG. 4.
Figure 6:
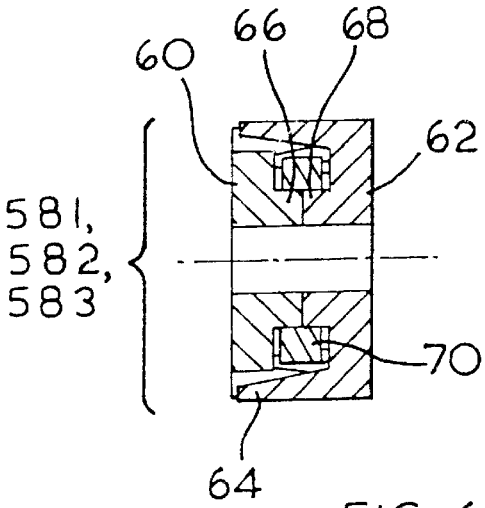
FIG. 6 shows a cross-sectional view of one stator element comprising two half-claw members joined to enclose a field coil.
Figure 8:
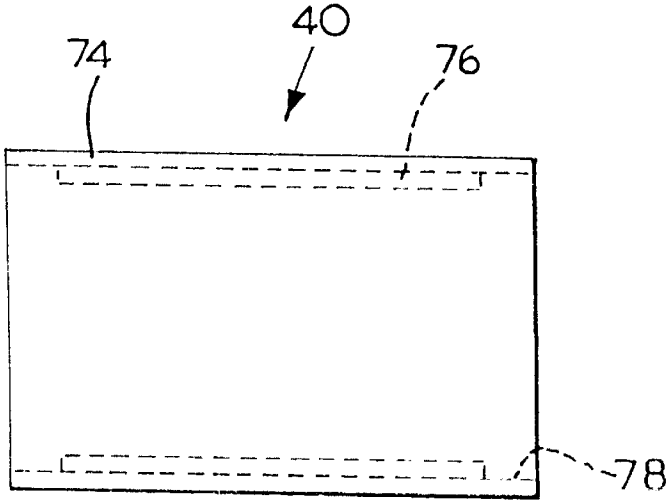
FIG. 8 shows a side elevation view of a rotor drum.
Figure 7:
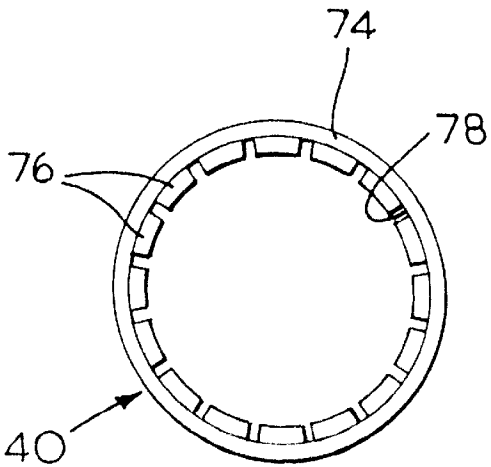
FIG. 7 shows a front elevation view of a rotor drum.
Figure 10:
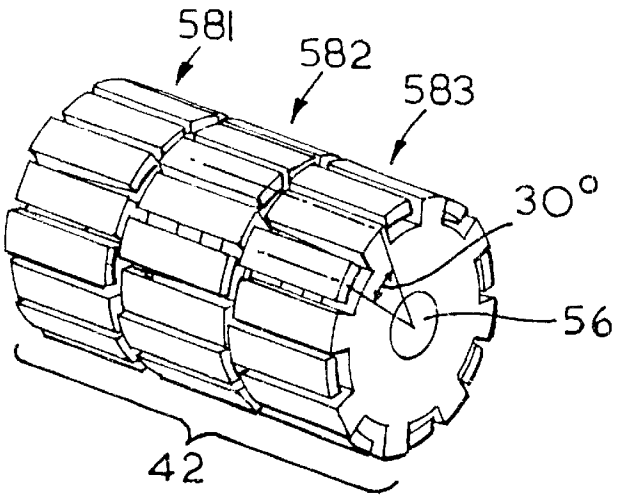
FIG. 10 shows a perspective view of a stator comprising three stator elements.
Figure 9:
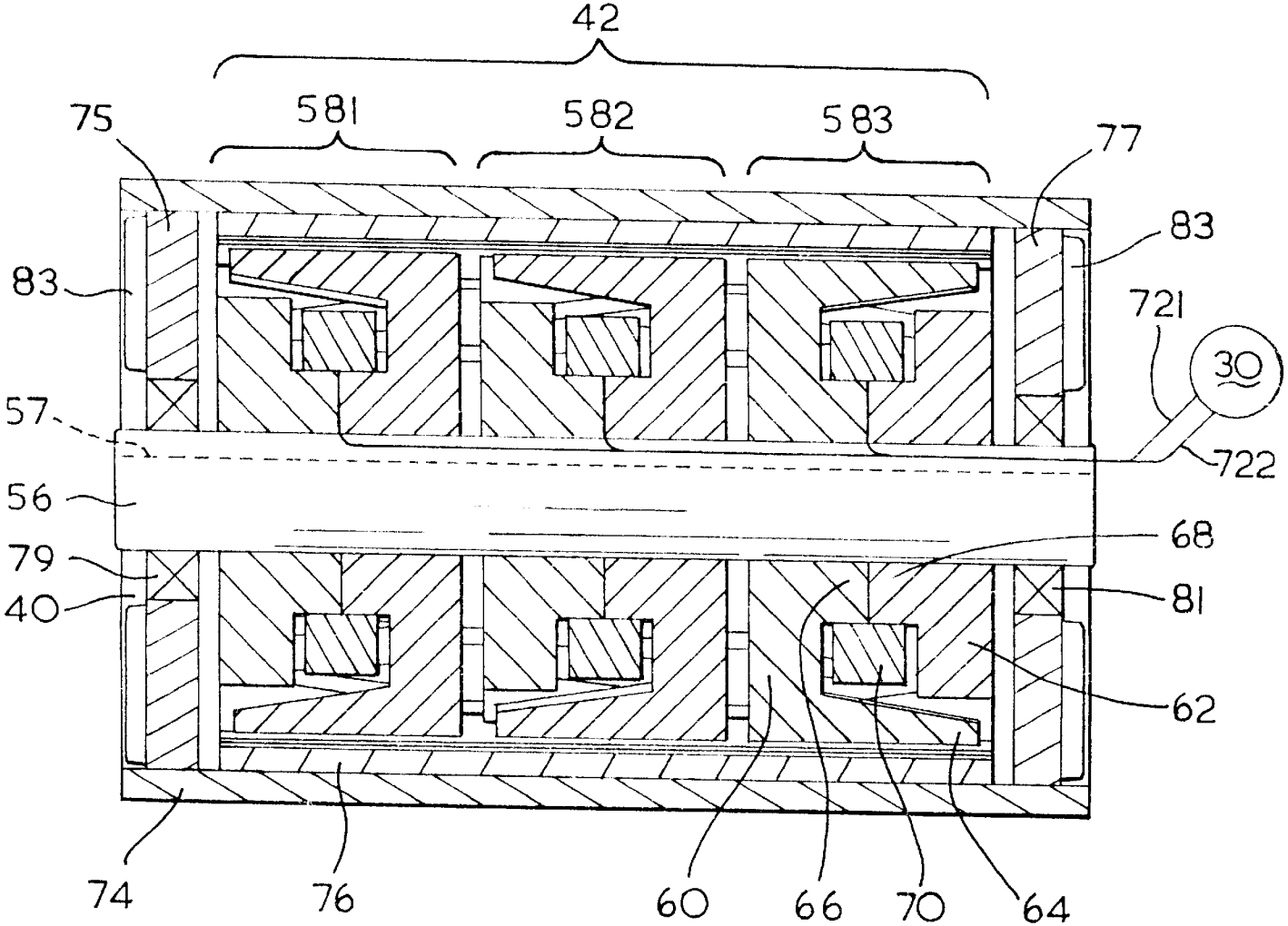
FIG. 9 shows a cross-sectional view of a claw pole motor comprising rotor drum including end faces with bearings and three stator elements mounted upon a shaft.

Referring to the drawings and in particular FIG. 1, a belt sander comprises a body element (20) having a handle (22), an electrical trigger switch (24) located in the handle (22), an electrical input cable (26) entering the body element (20) at the rear end of the handle (22) and capable of carrying electrical current, a casing (28) attached to the body element (20) and comprising a power module (30) and a belt tension adjuster (32), a non-driven roller (34) rotatably disposed upon an axle (36), the axle being attached to the belt tension adjuster (32) on one side, a driven roller (38) which is formed by a rotor drum (40) of an electric motor, a stator (42) of said electric motor about which rotates the outer rotor drum (40), the stator (42) being attached to the body element (20) on the same side as the axle (36) is attached to the belt tension adjuster (32), a sandpaper belt (44) smooth on the inside surface (46) and abrasive on the outside surface (48), the sandpaper belt (44) being located around and supported by the driven roller (38) and non-driven roller (34), wherein the casing (28) is located substantially between the driven roller (38) and non-driven roller (34) and the belt tension adjuster (32) is capable of altering the distance between the driven roller (38) and non-driven roller (34).

When in use, the sandpaper belt (44) is fitted around the driven roller (38) and the non-driven roller (34) and held under tension in the shape of a flat loop, the smooth internal side (46) of the sandpaper belt (44) being in contact with the driven roller (38) and the non-driven roller (34) and, the abrasive surface (48) facing outwardly. Operation of the belt tension adjuster (32) effects a change in the distance between the driven roller (38) and the non-driven roller (34) thereby altering the tension in the sandpaper belt (44). An increase in sandpaper belt tension to a pre-determined tension results in a firm contact between the smooth inner surface (46) of the sandpaper belt (44) and the outer surface of the driven roller (38) and the non-driven roller (34) as well as straightening both the upper (50) and lower (52) flat sides of the flat loop formed by the sandpaper belt (44). Conversely, a decrease in sandpaper belt tension results in a slackening of the sandpaper belt (44) thereby allowing the user to slide it off the driven roller (38) and the non-driven roller (34) and remove it in exchange for a replacement sandpaper belt (44).

The casing (28) comprises a rigid flat lower external surface forming a sole plate (54). The internal smooth surface (46) of the lower flat side (52) of the sandpaper belt (44) makes contact with and is supported by the sole plate (54) of the casing (28), the casing (28) being located inside the flat loop formed by the sandpaper belt (44) and between, but not in contact with, the driven roller (38) and non-driven roller (34). The support provided by the sole plate (54) is transferred to the outer abrasive surface (48) of the lower flat side (52) of the sandpaper belt (44) when the user presses the belt sander against the work surface during operation.

The casing (28) and the stator (42) are attached to the body element (20) on same side (side not shown in FIG. 1) as the axle (36) is attached to the belt tension adjuster (32) and, all these components, with the exception of the body element (20), are located within the loop formed by the sandpaper belt (44). This arrangement allows unhindered fitment or removal of the sandpaper belt (44) to and from the driven roller (38) and the non-driven roller (34) via the opposite side of the body element (20) and by operation of the belt tension adjuster (32).

The rotor drum (40) of the electric motor forms the surface of the driven roller (38) and is typically, although not necessarily, the same external diameter and axial length as the non-driven roller (34). The stator (42) of the electric motor remains stationary relative to the body element (20) while the rotor drum (40) turns about stator (42). The non-driven roller (34) is free to rotate about its axle (36) which, as stated above, is fixedly secured to the belt tension adjuster (32) on one side. The sandpaper belt (44) turns about the driven roller (38) and the non-driven roller (34) and travels along the surface of the sole plate (54) of the casing (28) when urged by the electric motor forming the driven roller (38).

A claw pole motor is the preferred choice of electric motor. Electrical machines with claw pole armatures are well known and offer high specific torque output using very simple and easily manufactured coils and soft magnetic components. With reference to FIGS. 2 to 10, the claw pole motor, as according to this invention, comprises:

a stator (42), comprising a central shaft (56) with a channel (57) and three electrically independent claw pole stator elements (581,582,583), each stator element comprising:

a substantially circular first half-claw member (60) having a first central element (66) and eight claws (64);

a substantially circular second half-claw member (62) having a second central element (68) and eight claws (64);

both half-claw members (60,62) being substantially the same, but opposing, and the eight claws (64) of each half-claw member (60,62) being arranged in equi-angular intervals around the perimeter of the substantially circular half-claw members (60,62), such that when the first central element (66) and the second central element (68) are joined together the claws (64) juxtapose each other, thereby forming an outer cylindrical drum of sixteen axially aligned claws (64);

a field coil (70) of insulated copper wire, preferably formed in the shape of a simple hoop, the field coil (70) being situated within the cylindrical space enclosed by the sixteen juxtaposed claws (64) and surrounding the central elements (66,68) of the two joined half-claw members (60,62). The field coil (70) is insulated from the half-claw members (60,62) and is connected to the power module (30) by two field coil wires (721,722) which exit an assembled claw pole stator element (581,582,583) via a gap between two claws (64), or through a hole in one of the central elements (66,68);

a rotor drum (40) comprising a cylindrical drum (74) with a circular end face (75,77) at each end and sixteen permanent magnets (76). Each end face (75,77) comprises a bearing (79,81) mounted upon the shaft (56) and a plurality of fins (83) disposed upon of the outside of the end face (75,77). The cylindrical drum (74) is supported by the end faces (75,77) and bearings (79,81) for rotational movement about the shaft (56). Sixteen magnetic poles are formed by the sixteen permanent magnets (76), each permanent magnet (76) being attached to the inner surface (78) of the cylindrical drum (74) and extending continuously along its axial length.

The half-claw members (60,62) are made of a ferromagnetic material. The preferred choice of material for the half-claw members (60,62) is a composite of soft iron powder, the soft iron powder being pre-coated in an insulating epoxy resin and held together by a bonding process to produce an isotropic ferromagnetic material. The first stage of this process is the compression of the soft iron powder composite into a mould shaped like a half-claw member. At this stage the powder is not yet bonded together and the half-claw member formed within the mould would disintegrate if removed from the rigid confines of the mould. The next stage of the process involves heating the powder to a temperature at which the epoxy resin fuses thereby linking together the soft iron powder particles. The final stage of the bonding process involves the soft iron powder composite cooling to a temperature at which the epoxy resin solidifies thereby permanently and solidly bonding the soft iron powder particles together into the shape of a half-claw member. A half-claw member (60,62) made of this type of soft iron composite benefits from a significant reduction in the iron losses caused by eddy currents, when compared to the solid mild steel structures commonly used for conventional claw pole cores. This is due to the epoxy resin forming an insulating layer between soft-iron powder particles which acts as a barrier inhibiting the circular flow of eddy currents that would normally be formed by an alternating magnetic field within the body of the half-claw members (60,62). Overall, the extremely low iron loss due to eddy currents is comparable to that of laminated steels, however claw pole member (60,62) made from laminated steel would be more difficult and therefore more costly to make than one made of the soft iron composite.

Construction of a claw pole stator element (581,582,583) begins with the assembly of two half-claw members (60,62) so that they are joined at their central elements (66,68) and reversed in such a way that their claws (64) juxtapose but do not touch each other, the claws (64) enclosing a cylindrical space occupied by the field coil (70). At this stage of assembly the half-claw members (60,62) are only held together by an assembly device (not shown) and, before progressing further, provision must be made for an exit point for the field coil wires (721,722) leading from the field coil (70) to the power module (30). The preferred means for uniting the two half-claw members (60,62) and field coil (70) is by a process called 'potting'. Potting of a claw pole stator element (581,582,583) involves impregnation of all air gaps between the two half-claw members (60,62) and field coil (70) with a liquid resin, the resin later solidifying and hardening to rigidly bond the these parts together. Once the potting process has been completed the assembly device can be removed because the bond formed by the solidified resin is strong enough to hold the claw pole stator element (581,582,583) permanently intact.

The stator (42) of the claw pole motor comprises three substantially the same claw pole stator elements (581,582,583), each one fixedly and concentrically disposed upon a shaft (56), the shaft (56) preferably being formed of non-magnetic material so as to minimise magnetic flux leakage between adjacent claw pole elements (581,582,583). The channel (57) extends along the full length of the shaft (56). The channel (57) is sufficiently wide and deep to provide a passage for the field coil wires (721,722) between the claw pole stator elements (581,582,583) and the exterior of the claw pole motor. The channel (57) is sealed at one end by a plug (not shown). The channel (57) is sealed at the other end by a rubber gland, or the like, (not shown) where the field coil wires (721,722) exit the channel (57). The plug and gland prevent entry of foreign particulate matter into the interior of the claw pole motor via the channel (57). In the embodiment shown in FIG. 9 the channel is arranged upon the surface of the shaft (56), however the channel (57) may be in the form of an internal channel or passage extending along the full length of the centre of the shaft (56). Each of the sixteen magnetic poles of a claw pole stator element (581,582,583) is mis-aligned by 30° (about the axis of the shaft (56)) relative to the equivalent magnetic pole of the neighbouring claw pole stator element (581,582,583), and this alignment gives the stator (42) a 'stepped' appearance. The stepped alignment of the three claw pole stator elements (581,582,583) relative to each other, as described above, effectively results in the stator (42) having a total of forty-eight magnetic poles (3×16 magnetic poles), meaning that the permanent magnets (76) of the rotor drum (40) travel less rotational distance between magnetic poles of the stator (42)

than they would if the sixteen magnetic poles of each of the three claw pole stator elements (581,582,583) were located in-line. A three-phase ac electrical supply, when supplied to the stator elements (581,582,583), produces a rotating magnetic field within the stator (42) capable of turning the rotor drum (40) with a very low level of cogging, this due to diminished rotational distance between the magnetic poles of the stator (42). 'Cogging' is a term used to describe non-uniform movement of the rotor such as rotation occurring in jerks or increments, rather than smooth continuous motion. Cogging arises when the poles of a rotor move from one pole of the stator to the next adjacent pole and is most apparent at low rotational speeds.

The cylindrical drum (74), end faces (75,77) and bearings (79,81) collectively surround the inner space of the rotor drum (40) in an air-tight manner such that the stator elements (581,582,583) and permanent magnets (76) are shielded from the entry of foreign particulate matter. During operation of the belt sander the fins (83) rotate with the end faces (75,77) and cylindrical drum (74) about the central shaft (56) to create additional air-flow in the region of the rotor drum (40) to cool the rotor drum (40) and its internal components. Furthermore, the cylindrical drum (74) is axially fixed along its full length with respect to the shaft (56) by the end faces (75,77) and bearings (79,81) located at each end. The end faces (75,77) and bearings (79,81) prevent axial loads applied to the exterior of the rotor drum (40) from axially deflecting any part of the rotor drum (74) towards the shaft (56), thus preventing damaging rubbing contact between the stator elements (581,582,583) and the rotating permanent magnets (76). The cylindrical drum (74) is also longitudinally fixed with respect to the shaft (56) by the end faces (75,77) and bearings (79,81). However, longitudinal forces applied to the rotor drum (40) are likely to be smaller than axial forces applied to the rotor drum (40) during use of the belt sander.

Figure 11:
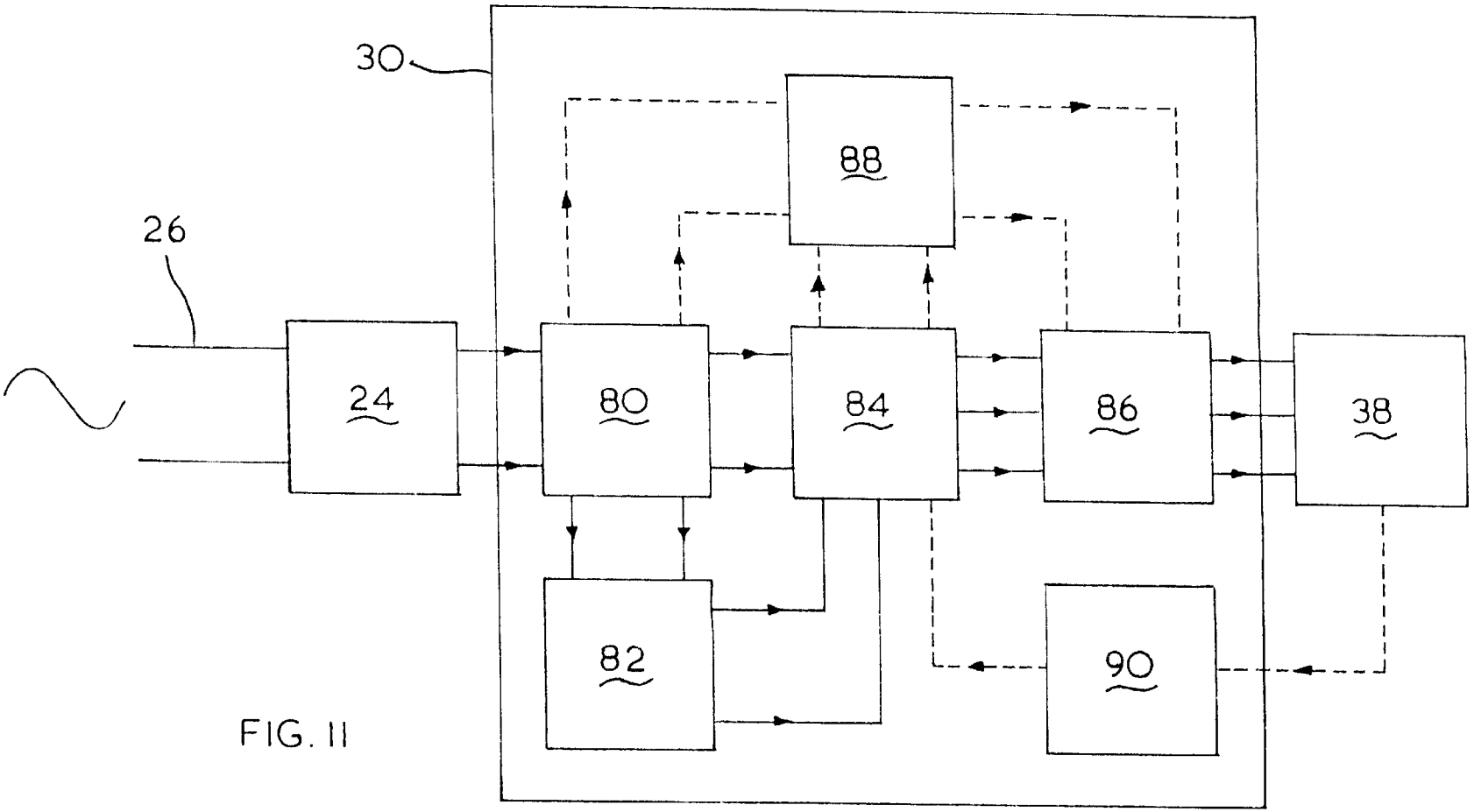
FIG. 11 shows a block diagram of the electronic power module.

The electric motor of a power tool may be directly driven by a domestic mains electrical supply or a battery electrical supply. However, power tools, like for example a belt sander, frequently use a power module to drive its electric motor in order to benefit from better control and efficiency that a power module may provide. Power modules capable of receiving a domestic mains electrical supply or a battery electrical supply and converting it into dc or ac, single phase or multiple phase supply, suitable for powering various types of electric motors are well know to the skilled person in the art. Following is a description, with reference to FIG. 11, of a typical power module (30) capable of supplying the claw pole motor, as according to this invention. The power module (30) is contained in a casing (28) and receives domestic mains electrical supply of 240V single-phase ac, via the electrical input cable (26) and the electrical trigger switch (24). The user selectively energises or de-energises the power module (30) by operation of the electrical trigger switch (24). A bridge rectifier (80) receives the domestic electrical supply of 240V ac from the electrical trigger switch (24) and converts it into a first link supply. A logic power supply (82) receives the first link supply and converts it into a second link supply which is then supplied to other power module components such as a drive controller (84) and a power switch (86). The drive controller (84) is programmed to control the power switch (86), and the power switch (86) comprises a three-phase bridge capable of driving a three-phase motor like, for example, the claw pole motor (38). The power module (30), as described herein above, is an open loop control system because no feedback regarding the speed or position of the claw pole motor (38) is supplied to the drive controller (84) during operation.

A closed loop control circuit is an optional addition to the electronic power module (30). In this example of a closed loop control circuit, the drive controller (84) controls the rotational speed of the claw pole motor (38) via the power switch (86) and a voltage control (88), while a position sensor (90) monitors the actual rotational speed of the claw pole motor (38) and simultaneously feeds the actual motor rotational speed back to the drive controller (84). The voltage control (88) receives the first link supply and converts this to a variable third link supply, the voltage of the third link supply being within the range of 0V and a voltage equivalent to the first link supply, the value within this range being determined by the drive controller (84). If feed-back from the position sensor (90) informs the drive controller (84) that the claw pole motor (38) is not operating at the correct predetermined rotational speed then the drive controller (84) has the choice of altering the voltage of the third link supply, as supplied by the voltage control (88) to the power switch (86), or, adjusting the operational frequency of the power switch (86), or both, in order to restore the claw pole motor (38) to the predetermined rotational speed. The feed back supplied by the position sensor (90) to the drive controller (84) forms the link that completes (or closes) the control circuit loop between the drive controller (84) and the claw pole motor (38) so that the claw pole motor (38) operates consistently and as close as possible to the correct predetermined rotational speed, regardless of external influences.

Figure 12:
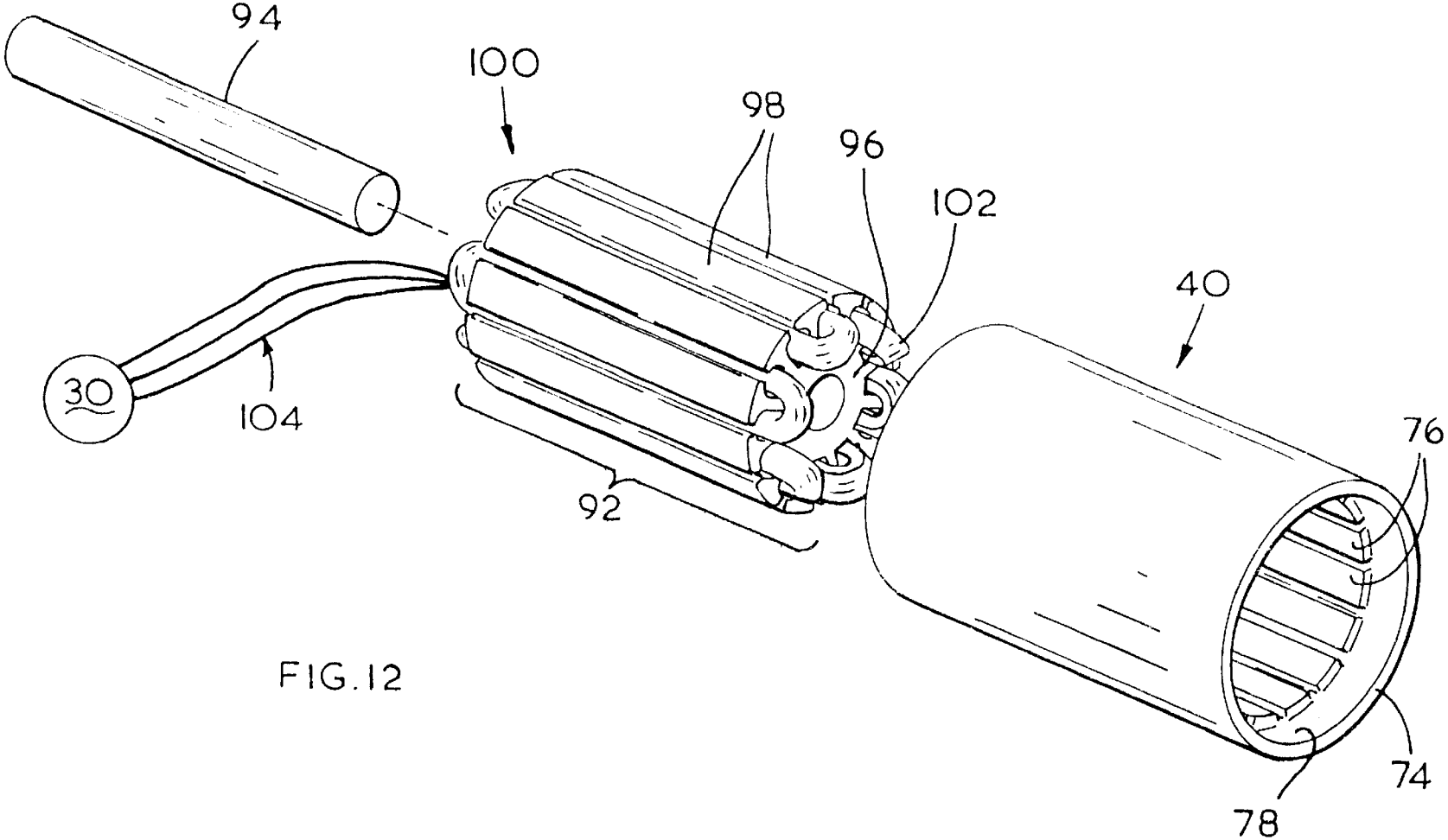
FIG. 12 shows an exploded perspective view of a laminated motor comprising a laminated core stator and an external rotor drum.

As will be apparent to the person skilled in the art other electric motors may be used as an alternative to the claw pole motor. Following is a description, with reference to FIG. 12, of a three-phase laminated core motor that could be directly substituted for the three-phase claw pole motor as described herein above. The three-phase laminated core motor comprises:

a stator (92) centrally mounted upon a shaft (94), the stator (92) comprising a laminated core (96) with twelve teeth (98) and an insulated field coil (100), the field coil (100) further comprising;

six independent and insulated field coils (102) (two coils per phase), the independent field coils (102) being wound alternately around the twelve laminated core teeth (98), each independent field coil (102) receiving an electrical supply via its respective field coil wire (104);

a rotor drum (40), comprising a cylindrical drum (74) and sixteen magnetic poles formed by sixteen permanent magnets (76). Each permanent magnet (76) is attached to the inner surface (78) of the cylindrical drum (74) and extends continuously along its axial length.

The laminated stator (92) has twelve teeth (98) and therefore twelve magnetic poles, arranged to produce a rotating magnetic field when the six independent field coils (102) are supplied with a three-phase ac electrical supply from the power module (30). The rotating magnet field urges the permanent magnets (76) of the rotor drum (40) to turn about the stator (92). The laminated stator (92) is skewed by one half tooth pitch in order to minimise cogging.

The laminated motor is similar to the claw pole motor in that it comprises an internal stator (92), rigidly connected to the body element (20) on one side, and an external rotor drum (40). Although not shown in FIG. 12, the rotor drum (40) of the laminated core motor may further comprise a circular end face (75,77) with a bearing (79,81) at each end, and a plurality of fins (83) disposed upon the outside of each circular end face (75,77), like the claw pole motor. Both are brushless shielded motors, driven by a 3-phase ac electrical supply, with an internal stator (40,92) about which turns substantially the same external rotor drum (40). Neither motor need necessarily be adapted for 3-phase ac electrical supply and claw pole or laminated motors of similar construction could be employed which are powered by other forms of electrical supply. The claw pole motor is the preferred choice of electric motor for this invention because of its simple and inexpensive construction.

What is claimed is:

1. A power tool comprising:

a body;

a motor having a stator fixed to the body and a rotor located outside the stator and rotatable about the stator;

a non-driven roller rotatably fixed to the body; and a sanding belt supported by the rotor and the non-driven roller.

2. The power tool of claim 1, wherein the body includes a handle with a trigger for activating the motor.

3. The power tool of claim 1, wherein the body includes a casing having a power module and a belt tension adjuster.

4. A power tool comprising:

a body; and a motor mounted to said body, said motor having a drum shaped outer surface that acts as a roller.

5. The power tool as claimed in claim 4 wherein the motor is an electric motor having a stator and rotor, wherein the rotor is located outside the stator and is capable of rotating about the stator.

6. A power tool comprising:

a body;

a motor mounted to said body, said motor having an outer surface that acts as a roller;

wherein the motor is an electric motor having a stator and rotor, wherein the rotor is located outside the stator and is capable of rotating about the stator;

wherein the power tool further comprises a non-driven roller; and wherein the power tool further comprises a belt, the rotor and the non-driven roller supporting the belt.

7. The power tool as claimed in claim 5 wherein the stator is attached to the body.

8. The power tool as claimed in claim 5 wherein the power tool further comprises a non-driven roller.

9. The power tool as claimed in claim 8 wherein the non-driven roller is rotatably disposed upon an axle, the axle being attached to the body.

10. The power tool as claimed in claim 5 wherein the rotor comprises;

a cylindrical drum; and a plurality of permanent magnets;

the permanent magnets being attached to an inside of the cylindrical drum.

11. The power tool as claimed in claim 5 wherein the stator is a claw pole stator comprising at least one claw pole stator element.

12. The power tool as claimed in claim 11 wherein a claw pole stator element comprises;

a field coil;

a first half-claw member comprising;

a first central element; and a plurality of claws, the claws being arranged in equiangular intervals around the perimeter of the first half-claw member; and a second half-claw member comprising;

a second central element; and a plurality of claws, the claws being arranged in equiangular intervals around the perimeter of the second half-claw member; and the claw pole stator element being formed when the first half claw member and the second half claw member are joined at the first central element and the second central element thereby causing the claws to juxtapose about the perimeter of the first half-claw member and the second half-claw member, the claws enclosing the field coil and, the field coil surrounding the joined first central element and second central element.

13. The power tool as claimed in claim 12 wherein the first half-claw member and the second half-claw member are formed of an isotropic ferromagnetic composite material.

14. The power tool as claimed in claim 5 wherein the stator further comprises a shaft and a plurality of claw pole stator elements, the claw pole stator elements each concentrically disposed upon the shaft.

15. The power tool as claimed in claim 5 wherein the stator comprises;

a laminated core having a plurality of laminated teeth;

a field coil; and a shaft;

the laminated core being fixedly secured upon the shaft.

16. The power tool as claimed in claim 4 wherein the motor is a brushless shielded motor.

* * * * *